United States Patent [19]

Garmon

[11] 4,219,148

[45] Aug. 26, 1980

[54] UNITARY PAPERBOARD DIVIDER DEVICE FOR A CARTON

[75] Inventor: Ivan E. Garmon, St. Joseph, Mo.

[73] Assignee: Champion International Corporation, Stamford, Conn.

[21] Appl. No.: 24,613

[22] Filed: Mar. 28, 1979

[51] Int. Cl.[2] ..... B65D 5/48

[52] U.S. Cl. ..... 229/28 R; 229/15; 229/42

[58] Field of Search ..... 229/28, 15, 42

[56] References Cited

U.S. PATENT DOCUMENTS

| | | | |
|---|---|---|---|
| 1,677,565 | 7/1928 | Oppenheim | 229/15 X |
| 3,201,022 | 8/1965 | Glassco et al. | 229/42 X |
| 3,616,897 | 11/1971 | Vrana | 229/15 X |
| 3,770,184 | 11/1973 | Rockefeller | 229/42 X |
| 3,980,223 | 9/1976 | Curran | 229/28 R |
| 3,982,684 | 9/1976 | David | 229/28 R |

FOREIGN PATENT DOCUMENTS

| | | | |
|---|---|---|---|
| 260884 | 4/1964 | Australia | 229/28 R |
| 2236892 | 2/1974 | Fed. Rep. of Germany | 229/28 R |
| 1257547 | 2/1961 | France | 229/28 R |
| 1271139 | 7/1971 | France | 229/28 R |
| 898656 | 6/1962 | United Kingdom | 229/28 R |

*Primary Examiner*—Davis T. Moorhead
*Attorney, Agent, or Firm*—Evelyn M. Sommer

[57] ABSTRACT

A unitary paperboard blank having joined consecutive rectangular panels aligned along a common axis is erected into a six-cell divider device for a carton to separate and protect articles, such as bottles, within the cells (compartments). The divider device has externally directed flaps which, in one embodiment, cooperate with the internal walls of the carton to provide four air cells around the protected articles. Two of the rectangular panels are joined to partition panels by fold lines, with each of the partition panels being erected perpendicularly to the rectangular panels to which it is joined and being inserted through a cut-out in a central divider rectangular panel.

12 Claims, 3 Drawing Figures

UNITARY PAPERBOARD DIVIDER DEVICE FOR A CARTON

BACKGROUND OF THE INVENTION

The present invention relates to a paperboard blank and a carton divider device for protecting and separating articles packed in a carton.

At the present time it is known that articles packed in a carton may be separated and protected by placing paperboard, such as corrugated single or double faced cardboard, between the articles. For example, bottles may be shipped with four interfitting separate paperboard panels acting as dividers within the carton. That system requires substantial labor to erect the dividers and does not offer protection between the carton walls and the contents. It is also possible to use rigid plastic foam for protection of packed articles, although such plastic foam may be relatively expensive.

SUMMARY OF THE INVENTION

In accordance with the present invention a paperboard divider blank and device is provided. The blank is a unitary paperboard blank having a series of consecutively articulated rectangular panels which are aligned along a common axis.

The panels are folded perpendicularly (at right angles) to form an erected structure having four walls, a central partition panel, and two cross partition panels which protrude through openings in the central partition panel. The four outer wall panels each have a top and bottom flap which flaps are folded outwardly to form protective "air cells" with the inner walls of the carton. The term "air cell" here means the space formed by the top and bottom flaps, the inner wall of the carton and a panel of the divider device.

OBJECTIVES AND FEATURES OF THE INVENTION

It is an objective of the present invention to provide a six-cell partition device for a carton which may be erected from a single paperboard blank, such single blanks being relatively inexpensive to produce as they require only one press run, such single blanks being relatively easy to store as they may be kept flat until ready for erection into the partition, and such single blanks being relatively easy to inventory as there is only one piece involved.

It is another objective of the present invention to provide a six-cell partition device for a carton which may be erected from a single paperboard blank which may be erected ("squared up") and held in its erected position using relatively less time and labor on its assembly and taping.

It is a still further objective of the present invention to provide a six-cell partition device for a carton which may be erected rom a single paperboard blank and which will provide protection to objects, for example, from damage caused by improper handling during shipment, by forming air cells with the carton on four sides around the objects.

It is a feature of the present invention to provide a unitary one-piece paperboard blank which may be die-cut and which is adapted to be erected into a six-cell partition device for a carton to protect the carton's contents by forming four side air cells with the interior walls of the carton. The blank includes a first rectangular panel having a free outer edge and an opposite and parallel first fold line. A second rectangular panel is connected to the first panel by the first fold line and has an opposite second fold line parallel thereto. A first partition panel, preferably an elongated rectangular panel, has a fold line internal to the first panel and has free edges formed within the first and second panels. Each panel of a first pair of connecting panels is connected by a portion of the second fold line to the second rectangular panel and has a portion of a third fold line parallel thereto. A third rectangular panel is connected by the third fold line to each of the first pair of connecting panels and has a fourth fold line parallel to its fold line.

The blank further includes a second pair of connecting panels each being connected by the fourth fold line to the third rectangular panel and having a portion of a fifth fold line parallel thereto. A fourth rectangular panel of the same size as the second rectangular panel is connected to the second pair of connecting panels by the fifth fold line and has a sixth fold line parallel thereto. A fifth rectangular panel of the same size as said first rectangular panel is connected to the fourth rectangular panel by the sixth fold line and has a free edge parallel thereto. A second partition panel has a fold line internal to the fifth panel and has free edges formed with the fifth panel and has free edges formed with the fifth and sixth panels and is adapted to fit within the cut-outs in the third and fourth panels. The blank also includes flap panels to form air cells with the internal wall of said carton. A pair of the flap panels is connected along fold lines to each of the first, fourth and fifth rectangular panels along their opposite edges.

BRIEF DESCRIPTION OF THE DRAWINGS

Other objectives of the present invention will be apparent from the following detailed description, providing the inventor's best mode of practicing the invention. The detailed description should be taken in conjunction with the accompanying drawings, in which.

DETAILED DESCRIPTION OF THE INVENTION

The divider device of the present invention is erected from a unitary paperboard blank, for example, a die-cut blank of corrugated cardboard.

Figure 1:
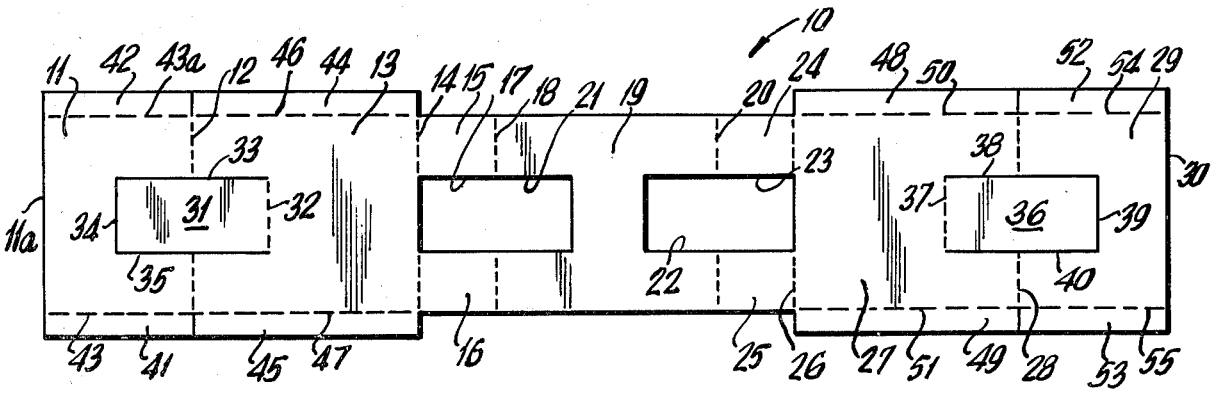
FIG. 1 is a top plan view of the unitary paperboard blank which is the first embodiment of the present invention.

The paperboard blank 10 of the first embodiment of the present invention is shown in FIG. 1. This blank 10 is erected into the divider device shown in FIG. 2. After forming the divider device in FIG. 2 it is inserted into a carton to protect and separate six articles, such as bottles, placed in the six cells (compartments) formed by the divider device.

As shown, blank 10 includes a first rectangular panel having free edge 11*a* and first fold line 12. A second rectangular panel 13 is connected to rectangular panel 11 by a fold line 12 and has an opposite and parallel fold line 14. Two rectangular connecting panels 15,16 form a cut-out opening 17 between them. Each connecting panel 15,16 is connected to rectangular panel 13 by a portion of a fold line 14 and has a portion of fold line 18 as its opposite and parallel end.

A third rectangular panel 19 lies between fold line 18 and its opposite and parallel fold line 20. The rectangular panel 19 has a first cut-out rectangular opening 21 continuous with opening 17 and a second cut-out rectangular opening 22 continuous with a cut-out opening 23. The opening 23 is formed between a second pair of rectangular connecting panels 24,25.

The connecting panels 24,25 lie between the fold lines 20,26. The fourth rectangular panel lies between fold line 26 and its opposite and parallel fold line 28. The fifth rectangular panel 29 is joined to the fourth rectangular panel 27 by fold line 28 and has a free edge 30.

A first rectangular partition panel 31 is connected to a second rectangular panel 13 by fold line 32 and has free edges 33,34,35. Similarly, a second rectangular partition panel 36 is connected to the fourth rectangular panel 27 by fold line 37 and has free edges 38,39,40.

Four pairs of flap panels are connected by fold lines to the rectangular panels which form the outer walls of the erected divider device. Specifically, flaps 41,42 are connected by respective fold lines 43,43*a* to first rectangular panel 11 at its top and bottom; flaps 44,45 are connected by respective fold lines 46,47 to rectangular panel 13; flaps 48,49 are connected by respective fold lines 50,51 to rectangular panel 27; and flaps 52,53 are connected by respective fold lines 54,55 to rectangular panel 29.

Figure 2:
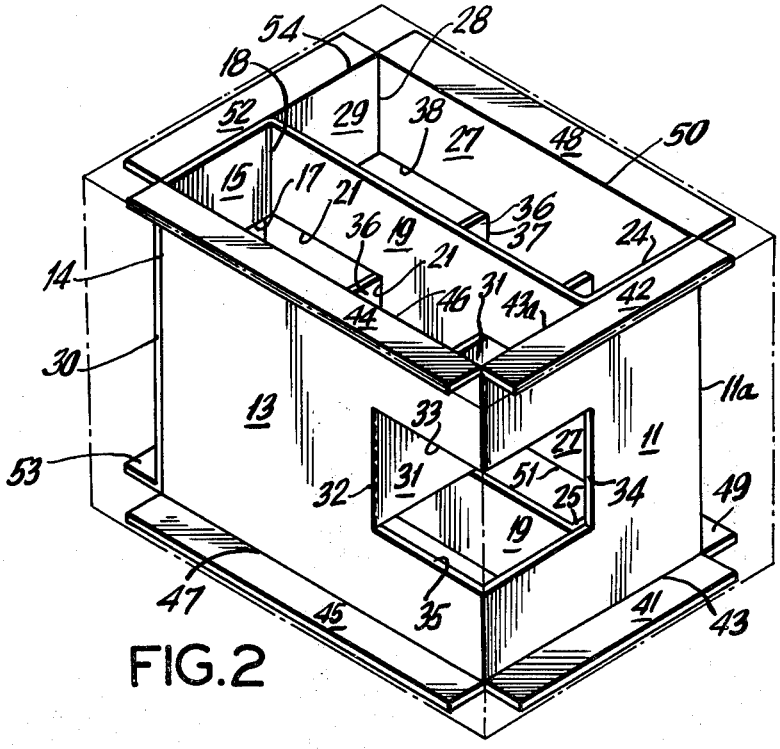
FIG. 2 is a perspective view of the divider device erected from the blank of FIG. 1.

As shown in FIG. 2, the divider device of the present invention is erected by folding the panels at right angles to form a perpendicular relationship. In sequence, starting with first rectangular panel 11, one may consider a fold-away from the drawing as "inward" (in relationship to the center of the erected divider device) and the 180° opposite direction as "outward".

The rectangular panel 13 is folded inwardly on fold line 12, the connecting panels 15,16 are folded inwardly along fold line 14, the rectangular panel 19 is folded inwardly along fold line 18, the connecting panels 24,25 are folded outwardly along fold line 20, the rectangular panel 27 is folded outwardly along fold line 26, the rectangular panel 29 is folded outwardly along fold line 28, the partition panel 31 is folded inwardly along line 32 and the partition panel 36 is folded outwardly along fold line 39.

The partition panel 31 is inserted through opening 21 and the partition panel 36 is inserted through opening 22. The rectangular panel 19 forms the central partition of the erected divider device together. However, in other case a tape may be used to connect the fifth panel to the second panel or glue may be used to adhere the fifth panel to the first pair of connecting panels.

The width of the flaps is selected so that they wedge into the carton, i.e., their free edges touch the inner carton walls, forming four air cells. For example, one air cell is formed by flaps 41,42 and the rectangular panel 11 and an inner wall of the carton.

Figure 3:
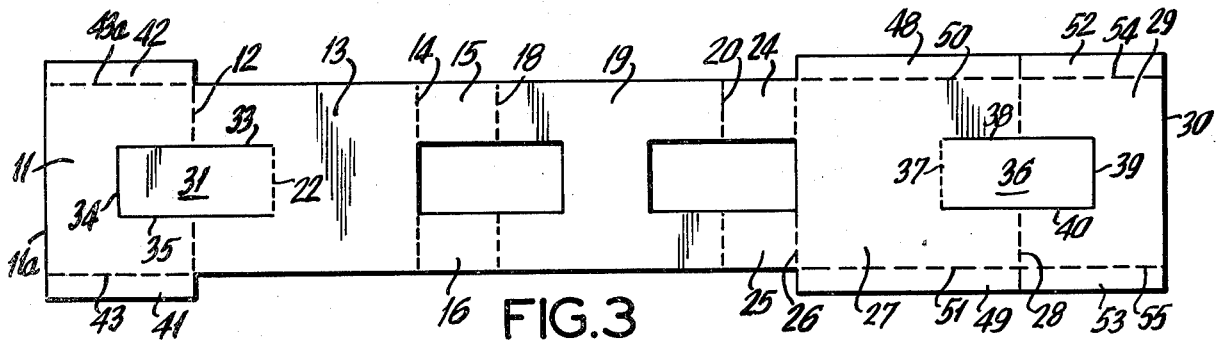
FIG. 3 is a top plan view of a unitary paperboard blank which is the second embodiment of the present invention.

The blank of the embodiment shown in FIG. 3 is similar to the blank of FIG. 1, except that the flaps 44,45 of FIG. 1 have been omitted. The divider device erected from the blank of FIG. 3 will form three air cells with the inner walls of the carton and is intended to stand next to a similar erected divider device, in a larger size carton, to form twelve compartments. The second rectangular panel 13 will be placed flush with the second rectangular panel of the other erected divider device.

What is claimed is:

1. A unitary one-piece paperboard blank for erection into a six-cell paperboard divider device, including:

a series of consecutively articulated rectangular panels which are aligned along a common axis, said blank being symmetrical relative to said axis;

said panels being four wall panels, a central partition panel having two cut-out openings, and two cross partition panels which are adapted to protrude through the cut-out openings in the central partition panel, the partition panels being connected along fold lines internal to two wall panels; and top and bottom flaps which are folded outwardly to form protective air cells, said top and bottom flaps comprising at least three pairs of such flaps attached along fold lines at opposite edges of three wall panels.

2. A unitary one-piece paperboard blank for erection into a six cell partition device for a carton, said blank including a plurality of rectangular panels which are articulated and lie along a common axis, said blank including:

a first rectangular panel having a free outer edge and an opposite and parallel first fold line;

a second rectangular panel connected to said first rectangular panel by said first fold line and having an opposite second fold line parallel thereto;

a first partition panel having a fold line internal to said second panel and having free edges formed within said first and second panels;

a first pair of connecting panels, each panel of said first pair being connected by a portion of said second fold line to said second rectangular panel and having a portion of a third fold line parallel thereto;

a third rectangular panel connected by said third fold line to each of said first pair of connecting panels and having a fourth fold line parallel thereto;

a second pair of connecting panels, each of said second pair of connecting panels being connected by said fourth fold line to said third rectangular panel and having a portion of a fifth fold line parallel thereto;

a fourth rectangular panel of the same size as said second rectangular panel and connected to said second pair of connecting panels by said fifth fold line and having a sixth fold line parallel thereto;

a fifth rectangular panel of the same size as said first rectangular panel connected to said fourth rectangular panel by said sixth fold line and having a free edge parallel thereto;

a second partition panel having a fold line internal to said fourth panel and having free edges formed with said fourth and fifth panels and adapted to fit within the said cut-outs in said third;

said third rectangular panel having two cut-out openings each sufficiently large to receive a respective partition panel; and flap panels to form protective air cells, a pair of said flap panels being connected along fold lines to each of said first, fourth and fifth rectangular panels along opposite edges of those said rectangular panels.

3. An integral blank as in claim 2 wherein said first and second partition panels are rectangular panels.

4. An integral blank as in claim 2 wherein said partition panels are of the same size.

5. An integral blank as in claim 3 wherein said cut-outs are rectangular and of the same size as said partition panels.

6. An integral blank as in claim 2 wherein said flap panels are elongated rectangular panels each of which extends the width of the rectangular panel to which it is connected.

7. An integral blank as in claim 2 wherein said first pair of connecting panels forms between them a cut-out to receive said first partition panel.

8. An integral blank as in claim 6 wherein said second pair of connecting panels forms between them a cut-out to receive said second partition panel.

9. An integral blank as in claim 2 and further including an additional pair of flap panels to form air cells connected along fold lines to said second rectangular panel along its opposite edges.

10. A unitary one-piece cardboard blank for erection into a six-cell partition device for a carton, said blank including a plurality of rectangular panels which are articulated and line along a common axis, said blank including:

a first rectangular panel having a free outer edge and an opposite and parallel first fold line forming between them a width dimension W;

a second rectangular panel connected to said first panel by said first fold line and having an opposite and second fold line parallel thereto;

a first rectangular partition panel having a fold line internal to said second panel and having free edges formed within said first and second panels;

a first pair of connecting panels forming between them a rectangular cut-out opening, each panel of said first connecting pair being rectangular and being connected by a portion of said second fold line to said second rectangular panel and having a portion of a third fold line parallel thereto, with the width of each of said connecting panels between said second and third fold lines being one-half W;

a third rectangular panel connected by said third fold line to each of said first pair of connecting panels and having a fourth fold line parallel thereto;

a second pair of connecting panels forming between them a second rectangular cut-out opening, each of said second pair of connecting panels being connected by said fourth fold line to said third rectangular panel and having a portion of a fifth fold line parallel thereto, with the width of each of said connecting panels between said fourth and fifth fold lines being one-half W;

a fourth rectangular panel of the same size as said second rectangular panel and connected to said second pair of connecting panels by said fifth fold line and having a sixth fold line parallel thereto;

a fifth rectangular panel of the same size as said first rectangular panel, connected to said fourth rectangular panel by said sixth fold line and having a free edge parallel thereto;

a second rectangular partition panel the same size as said first rectangular partition panel and having a fold line internal to said fourth panel and having free edges formed with said fourth and fifth panels and adapted to fit within the said cut-outs in said third;

said third rectangular panel having two equal rectangular cut-out openings of equal size and respectively continuous with said first and second cut-out openings and each slightly larger than the height of said partition panel; and flap panels to form air cells with the internal wall of said carton, a pair of said flap panels being connected along fold lines to each of said first, fourth and fifth rectangular panels along opposite edges of those said rectangular panels.

11. A unitary one-piece paperboard six-cell partition device for a carton, said device comprising a plurality of panels which are consecutively articulated, said blank including:

a first rectangular panel having a free outer edge and an opposite and parallel first fold line;

a second rectangular panel connected perpendicularly to said first rectangular panel by said first fold line and having an opposite second fold line parallel thereto;

a first partition panel connected perpendicularly to said second rectangular panel by a fold line internal to said second panel;

a first pair of connecting panels, each panel of said first pair being connected perpendicularly to said second rectangular panel by a portion of said second fold line and having a portion of a third fold line parallel thereto;

a third rectangular panel forming a central partition and connected by said third fold line perpendicularly to each of said first pair of connecting panels and having a fourth fold line parallel thereto, said third rectangular panels having two cut-out openings;

a second pair of connecting panels, each of said second pair of connecting panels being connected by said fourth fold line perpendicularly to said third rectangular panel and having a portion of a fifth fold line parallel thereto;

a fourth rectangular panel of the same size as said second rectangular panel and connected perpendicularly to said second pair of connecting panels by said fifth fold line and having a sixth fold line parallel thereto;

a fifth rectangular panel of the same size as said first rectangular panel and connected perpendicularly to said fourth rectangular panel by said sixth fold line and having a free edge parallel thereto;

a second partition panel connected perpendicularly to said fourth rectangular panel by a fold line internal to said fourth panel;

wherein said partition panels fit through said cut-out openings in said third rectangular panel to form a six-cell partition;

and flap panels externally directed relative to said central partition to form air cells with the internal wall of said carton, a pair of said flap panels being connected along fold lines to each of said first, fourth and fifth rectangular panels along opposite edges of those said rectangular panels.

12. A unitary one-piece paperboard six-cell partition device for a carton, said device comprising a plurality of panels which are consecutively articulated, including:

a first rectangular panel having a free outer edge and an opposite and parallel first fold line;

a second rectangular panel connected perpendicularly to said first rectangular panel by said first fold line and having an opposite second fold line parallel thereto;

a first partition panel connected perpendicularly to said second rectangular panel by a fold line internal to said second panel;

a first pair of connecting panels, each panel of said first connecting pair being connected perpendicularly to said second rectangular panel by a portion of said second fold line and having a portion of a third fold line parallel thereto;

a third rectangular panel forming a central partition connected by said third fold line perpendicularly to each of said first pair of connecting panels and having a fourth fold line parallel thereto;

a second pair of connecting panels, each of said second pair of connecting panels being connected by said fourth fold line perpendicularly to said third rectangular panel and having a portion of a fifth fold line parallel thereto;

a fourth rectangular panel of the same size as said second rectangular panel and connected perpendicularly to said second pair of connecting panels by said fifth fold line and having a sixth fold line parallel thereto;

a fifth rectangular panel of the same size as said first rectangular panel and connected perpendicularly to said fourth rectangular panel by said sixth fold line and having a free edge parallel thereto;

a second partition panel connected perpendicularly to said fourth rectangular panel by a fold line internal to said fourth panel;

and flap panels externally directed relative to said central partition to form air cells with the internal wall of said carton, a pair of said flap panels being connected along fold lines to each of said first, fourth and fifth rectangular panels along opposite edges of those said rectangular panels;

wherein said partition panels fit through said cut-out openings in said third rectangular panel to form a six-cell partition; and wherein each of said connecting panels is rectangular and of the same size and the first and second pair of connecting panels are flush against respectively the fifth and first rectangular panels.

* * * * *